US006575616B2

(12) United States Patent
D'Agostino

(10) Patent No.: US 6,575,616 B2
(45) Date of Patent: Jun. 10, 2003

(54) IMPELLER AND SHIELD FOR MIXING APPARATUS

(76) Inventor: William D'Agostino, 825 N. 3rd Ave., Tucson, AZ (US) 85705

( * ) Notice: Subject to any disclaimer, the term of this patent is extended or adjusted under 35 U.S.C. 154(b) by 0 days.

(21) Appl. No.: 09/849,129

(22) Filed: May 4, 2001

(65) Prior Publication Data

US 2002/0163856 A1 Nov. 7, 2002

(51) Int. Cl.[7] ..... B01F 7/26; B01F 15/00

(52) U.S. Cl. ..... 366/316; 366/317; 366/347

(58) Field of Search ..... 366/311, 315–317, 366/342, 343; 416/231 R, 231 A, 231 B

(56) References Cited

U.S. PATENT DOCUMENTS

| | | | | |
|---|---|---|---|---|
| 623,668 | A | * | 4/1899 | Holt, Jr. |
| 1,582,518 | A | * | 4/1926 | Horrell |
| 1,692,617 | A | * | 11/1928 | Bowen |
| 2,170,280 | A | * | 8/1939 | Sharp |
| 2,268,038 | A | * | 12/1941 | Knittel |
| 2,552,057 | A | * | 5/1951 | Paik |
| 2,573,837 | A | * | 11/1951 | Fox |
| 2,734,728 | A | * | 2/1956 | Myers |
| 2,809,021 | A | * | 10/1957 | Laden et al. |
| 2,984,462 | A | * | 5/1961 | O'Connor |
| 3,044,750 | A | * | 7/1962 | Schmitt, Jr. |
| 3,147,958 | A | * | 9/1964 | Stiffler |
| 3,630,636 | A | * | 12/1971 | Hill |
| 4,175,875 | A | * | 11/1979 | Van Horbek |
| 4,577,975 | A | * | 3/1986 | McCrory et al. |
| 4,813,787 | A | * | 3/1989 | Conn |
| 4,979,986 | A | * | 12/1990 | Hill et al. |
| 5,090,816 | A | * | 2/1992 | Socha |
| 5,292,193 | A | * | 3/1994 | Funk |
| 5,501,523 | A | * | 3/1996 | Weetman et al. |

FOREIGN PATENT DOCUMENTS

| | | | |
|---|---|---|---|
| JP | 6-63372 | * | 3/1994 |

* cited by examiner

*Primary Examiner*—Charles E. Cooley
(74) *Attorney, Agent, or Firm*—Gavin J. Milczarek-Desai; Durando Birdwell & Janke PLC

(57) ABSTRACT

An impeller and shield for a mixing apparatus. A mixing member has upper and lower opposite faces and one or more apertures therethrough. Each of the apertures has an upper periphery defined by an edge of the lower face and a lower periphery defined by an edge of the upper face. The mixing member is preferably an otherwise substantially planar disc having a hole through the center for receiving a motor driven shaft. Preferably, a separate shield member having upper and lower opposite surfaces and an aperture therethrough for receiving the shaft of the motor driven impeller is provided. The impeller and shield are used in combination to minimize the escape of particulate matter into the surrounding air during a mixing operation.

5 Claims, 4 Drawing Sheets

IMPELLER AND SHIELD FOR MIXING APPARATUS

BACKGROUND OF THE INVENTION

The present invention relates to an impeller for a mixing apparatus; particularly for a mixture wherein at least one of the ingredients is in powder or particulate form.

The present inventor has recognized the need to be able to mix powder and other ingredients, which may be liquids, pastes or gels, and minimize the introduction of powder particles into the surrounding air. For example, in a beauty salon, powdered bleach is mixed with other hair coloring materials, the powdered bleach particles representing a health hazard to persons who would inhale them.

Typical mixing impellers employ blades, such as those described in Wheetman et al., U.S. Pat. No. 5,501,523 and Hill et al., U.S. Pat. No. 4,979,986, or teeth, such as described in Funk, U.S. Pat. No. 5,292,193. Splatter shields are also provided in the prior art, such as those described in Hawke, U.S. Pat. No. 3,913,896, Schiffner et al., U.S. Pat. No 4,549,811 and Sadek-Patt, U.S. Pat. No. 6,123,449. However, the present inventor is not aware of a mixing impeller or splatter shield optimally suited to minimize the contamination of surrounding air by substantially dry particulate matter as a result of the agitation involved in mixing. Blades and teeth roughly agitate and scatter particles such as dry powder in addition to mixing the particles, and prior art splatter shields such as that of the '896 Patent provide openings through which the scattered particles can escape into the air both upwardly and radially outwardly Accordingly, there is a need for an impeller and shield for a mixing apparatus that provides for minimizing the introduction of particulate matter into the air proximate a mixing operation at low cost.

SUMMARY OF THE INVENTION

The impeller and shield for a mixing apparatus of the present invention solves the aforementioned problems and meets the aforementioned needs by providing an impeller member having an upper face and a lower face that is at a lower elevation than the upper face, and one or more apertures extending through both faces. Each of the apertures has an upper periphery and a lower periphery that is at a lower elevation than the upper periphery. The apertures are formed such that the upper periphery is defined by an edge of the lower face and the lower periphery is defined by an edge of the upper face. The impeller member may be formed of a substantially planar plastic disc, wherein the apertures may be formed by cutting slits through the disc and deforming the plastic at the slits to "open up" the slits sufficiently to pass particles to be mixed. The impeller member is attached or attachable to a motor driven shaft.

Preferably, a separate shield member is also provided having upper and lower opposite surfaces and an aperture therethrough. The aperture of the shield member has a width dimension that is larger than the diameter of the shaft. A dust flap member is removably disposed over the slot, leaving, however, space for the shaft to penetrate through the slot, to hinder or prevent the slot from conducting particulate matter upwardly from the container to the surrounding air. The dust flap member preferably includes a plug portion adapted to extend into and block the slot, to hinder or prevent the slot from conducting particulate matter radially outwardly from the container to the surrounding air.

Therefore, it is a principal object of the present invention to provide a novel and improved impeller and shield for a mixing apparatus.

It is another object of the present invention to provide an impeller and shield for a mixing apparatus that provides for minimizing the introduction of particulate matter into the air surrounding a mixing operation.

It is yet another object of the present invention to provide such an impeller and shield that provides for economy of purchase and use.

The foregoing and other objects, features and advantages of the present invention will be more readily understood upon consideration of the following detailed description of the invention, taken in conjunction with the following drawings.

DETAILED DESCRIPTION OF A PREFERRED EMBODIMENT

Figure 1A:
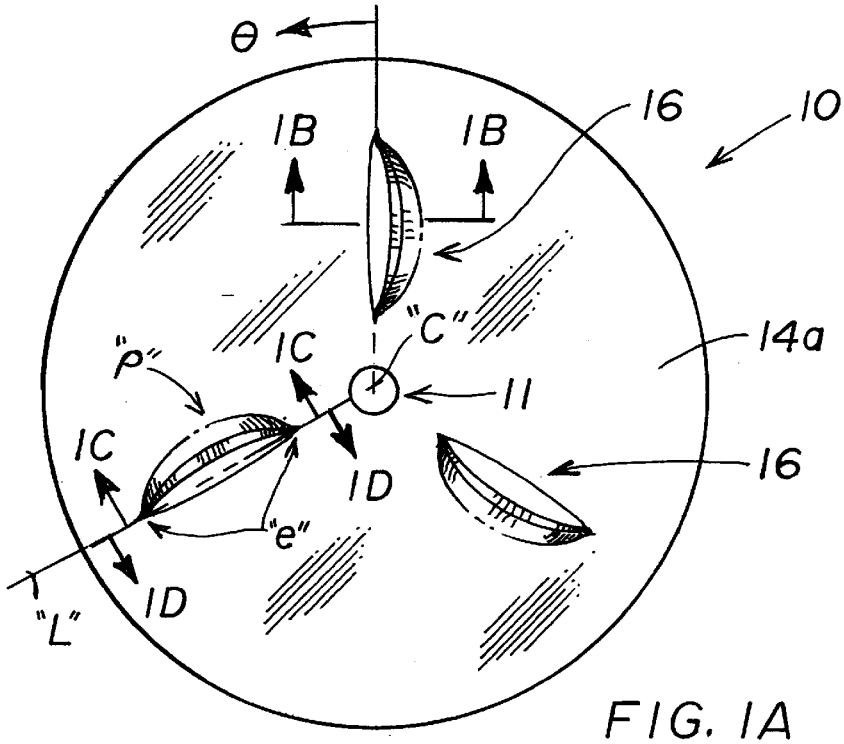
FIG. 1A is a plan view of an impeller according to the present invention for a mixing apparatus.

Referring to FIGS 1A–1D, an impeller 10 according to the present invention for a mixing apparatus is shown. FIG. 2 provides an example of such a mixing apparatus, showing the impeller 10 installed in a hand-held device 9 ready for mixing. The impeller 10 is rotated in the direction shown by its connection through a center hole 11 to a motor driven shaft 12, though the impeller may be attached to the shaft in any manner known in the art and may be permanently attached. The impeller may be used for mixing anything for which it is efficacious; however, it is particularly well adapted for mixing substances that include fine powder, such as the commercially available powdered bleach commonly used in hair salons.

In low production volumes, the impeller 10 is economically formed of a substantially planar, plastic disc with modifications as described herein; however, the impeller may be formed of other materials, such as metal as will be readily apparent to those of ordinary skill. The disc has upper and lower opposite faces 14*a* and 14*b*, wherein "upper" and "lower" are used herein as relative terms and do not imply an orientation of the impeller in space.

The faces 14 are pierced through by one or more apertures 16. In plan, such as shown in FIG. 1A, the apertures are elongated along radially extending lines "L" passing through the center "C" of the disc. The apertures have a shape that can best be illustrated by describing a simple manufacturing process carried out on the aforementioned plastic disc as described below. This process is economical when the impeller 10 is manufactured in low volumes.

This process begins by cutting a slit, such as with a knife, through the disc along a chosen radially extending line.

Then, the aperture is "opened up" to appear as shown in the Figures. For example, a pencil or similar elongate object can be inserted through the slit in a direction perpendicular to the faces 14 and then forcibly angled so that it lies more nearly parallel to the faces 14, thus stretching and deforming the upper and lower faces. The actual process used to manufacture the impeller 10 may be any known, desired method appropriate for the material used. For example, the impeller may be molded (or cast), and the shape of the apertures may be formed in the mold.

Figure 1B:
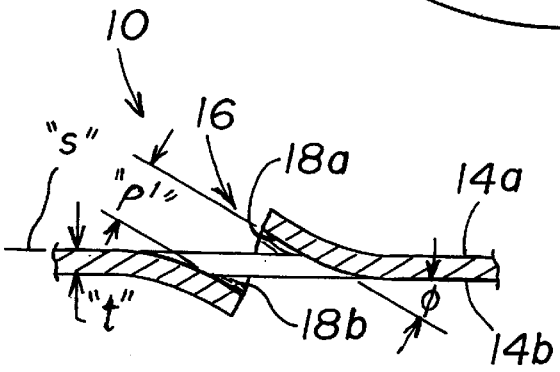
FIG. 1B is a side view of the impeller of FIG. 1A, taken along a line 1B—1B thereof.
Figure 1C:
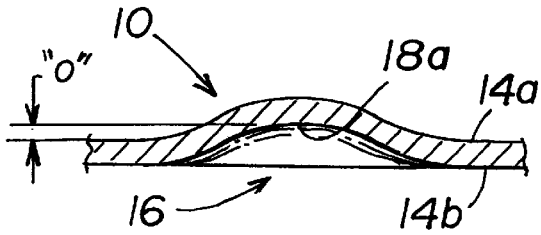
FIG. 1C is a side view of the impeller of FIG. 1A, taken along a line 1C—1C thereof.
Figure 1D:
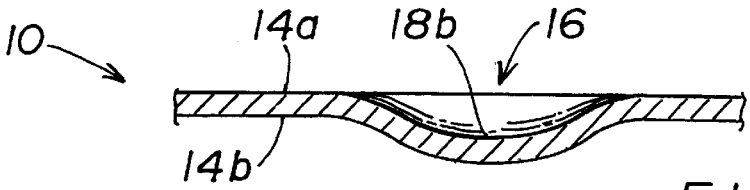
FIG. 1D is a side view of the impeller of FIG. 1A, taken along a line 1D—1D thereof.
Figure 2:
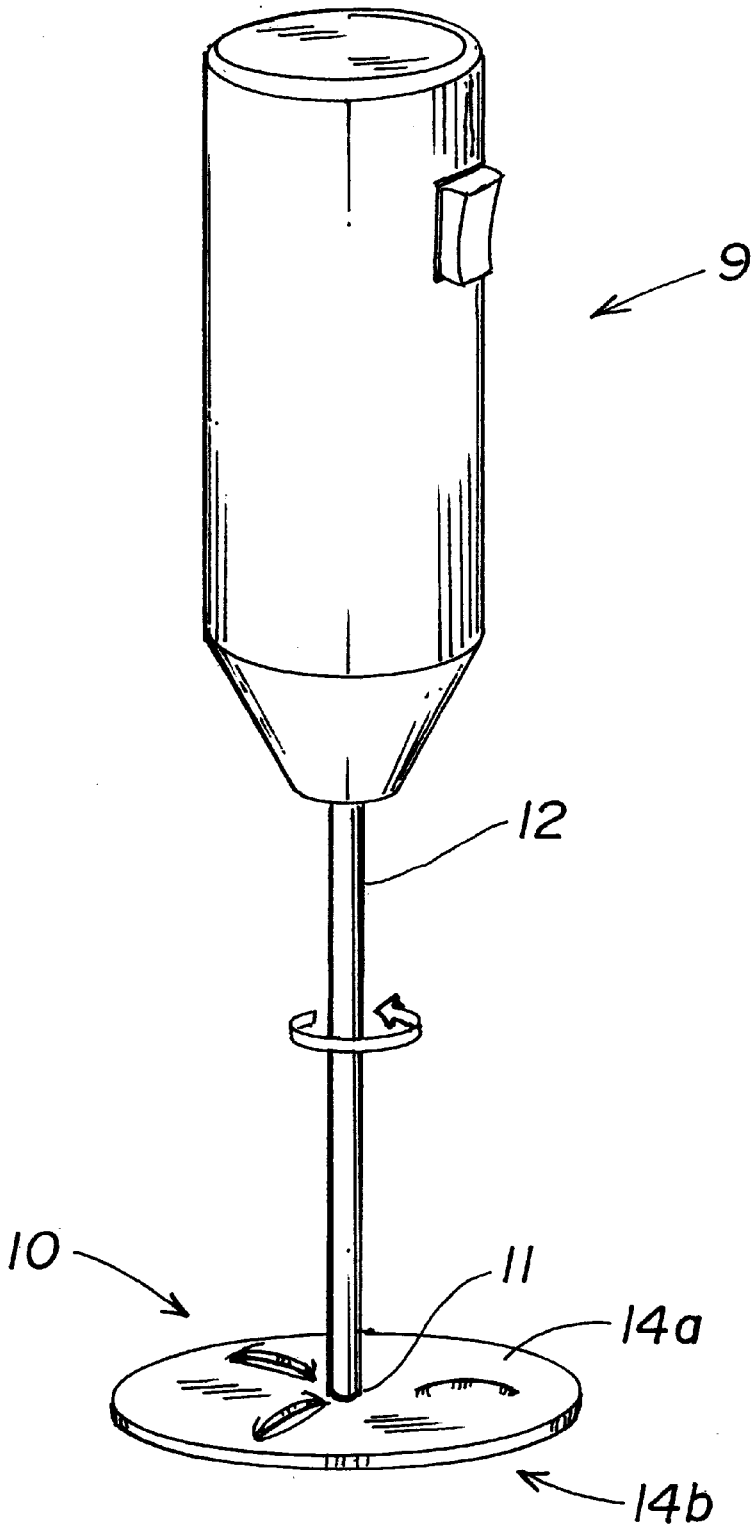
FIG. 2 is a pictorial view of a mixing apparatus with the impeller of FIG. 1A installed thereto.

Referring to FIGS. 1B–1D, the apertures have upper and lower peripheries 18*a*, 18*b*, wherein the terms "upper" and "lower" are used consistently with the same terminology used above to describe the faces 14*a*, 14*b*. The faces are stretched sufficiently that an edge of the lower face defining the aperture is elevated to become an upper periphery of the aperture, while a corresponding edge of the upper face is lowered to become a lower periphery of the aperture. This produces a substantial "opening up" of the slits that can be seen when the disc is viewed edge-on as in FIGS. 1B–1D.

Preferably, the impeller employs three of the apertures 16, and the apertures are spaced equal azimuthal angles θ apart from one another to dynamically balance the forces exerted on the impeller by the material being mixed. However, no more than one aperture is required, and any greater number may be provided, spaced at any desired interval with respect to one another, without departing from the principles of the invention.

As can be seen in FIG. 1B, considering an axis "s" lies in the plane of the disc, the upper and lower peripheries 18*a*, 18*b* are in 180 degree symmetry with respect to each other. Thence, the lower face 14*b* extends from the periphery 18*a* an angle ϕ which parallels the extension of the upper face 14*a* from the periphery 18*b*. As can be appreciated from FIG. 1B in combination with FIGS. 1C and 1D, the faces 14 will extend from their corresponding peripheries 18*a*, 18*b* a maximum angle ϕ at the mid-point "P" (FIG. 1A) of the peripheries, the angle ϕ diminishing with distance in either radial direction away from this point to substantially zero at radially innermost and radially outermost endpoints "e." Preferably, the maximum angle ϕ is between about 20 and 25 degrees.

A preferred impeller disc has a diameter of about 2", has a thickness "t" (FIG. 1B) of about 1/16," with apertures radially extending about ½," each having a maximum opening "o" (FIG. 1C) that is sufficiently large to pass the particles to be mixed therethrough, though the maximum opening "o" can be smaller than this and particles may still pass through the apertures so long as the maximum opening "p'" (FIG. 1B) is sufficiently large to pass the particles. The apertures of the preferred impeller disc for mixing powdered bleach have a maximum opening "p'" of about 1/10."

Figure 3:
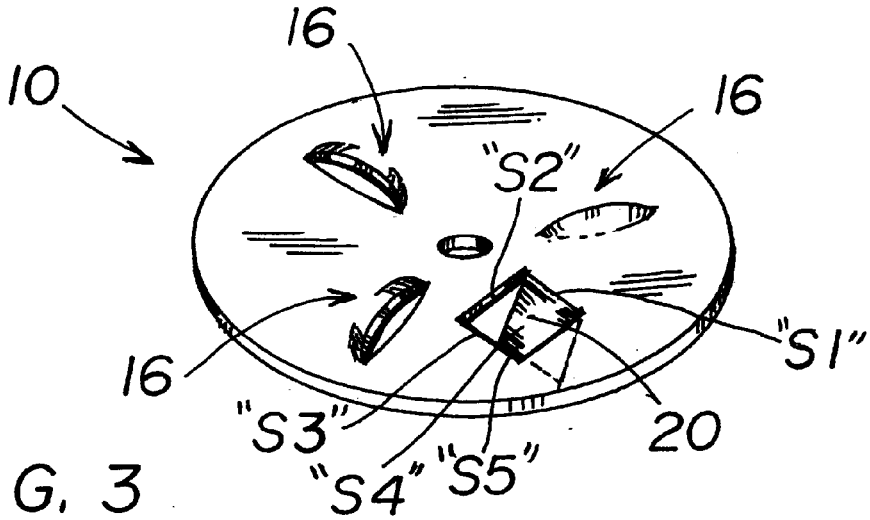
FIG. 3 is a pictorial view of the impeller of FIG. 1A with a scraping tab according to the present invention.

Turning to FIG. 3, the impeller 10 also preferably includes a scraping flap 20 that is hingedly connected to the impeller, along the line "s1." In the manual manufacturing process using the planar disc, the flap is conveniently formed by cutting three slits ("s2", "s3", "s4") through the disc arranged as three sides of a quadrilateral, the fourth side functioning as a hinge that results from pressing the flap downwardly.

The mixing apparatus is held with the impeller installed so that the end "s5" of the flap scrapes the bottom of a container holding the ingredients to be mixed This provides for an extra measure of mixing, and provides it at the bottom of the container where material overhead safely contains any material that is agitated by the flap 20.

Figure 4:
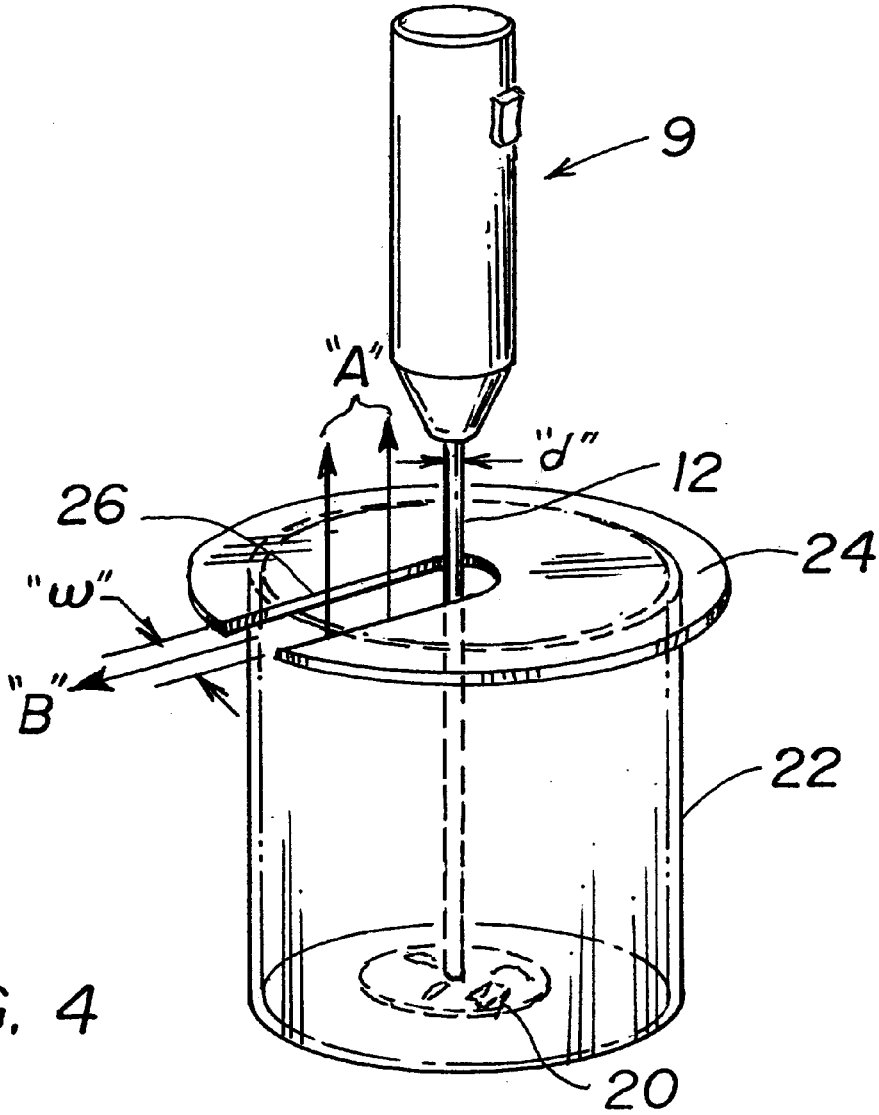
FIG. 4 is a pictorial view of the mixing apparatus of FIG. 2 with the impeller of FIG. 3 installed thereto, and a container and shield according to the present invention.

FIG. 4 shows the mixing apparatus of FIG. 2 with the impeller of FIG. 3 installed in a container 22 for holding one or more materials to be mixed. A shield 24 is preferably provided according to the invention to further decrease the risk of spreading particulate material or dust into the air. The shield is preferably planar, for sealing against a typical mouth of the container 22 that lies substantially in a plane, a configuration that may be modified accordingly for sealing against other types of surfaces. The shield is preferably provided with an aperture 26, preferably a slot, that extends from the periphery of the shield member to, preferably, about the center of the shield member such as shown, with a precisely central location being preferred to optimize mixing of the entire quantity of material in the container 22. The slot opens at the periphery to receive the shaft 12 laterally into and vertically through the slot. The slot therefore has a larger width "w" than the diameter "d" of the shaft 12; however, this size difference is preferably minimized to more tightly confine particulate matter in the container. The slot provides the advantage that the impeller 10 need not be removed from the shaft in order to insert the shaft through the shield. Alternatively, an aperture that does not open to the periphery of the shield member may be employed, and if the size of the aperture is minimized to fit the shaft, the impeller 10 may be installed after inserting the shaft through the aperture.

Figure 5:
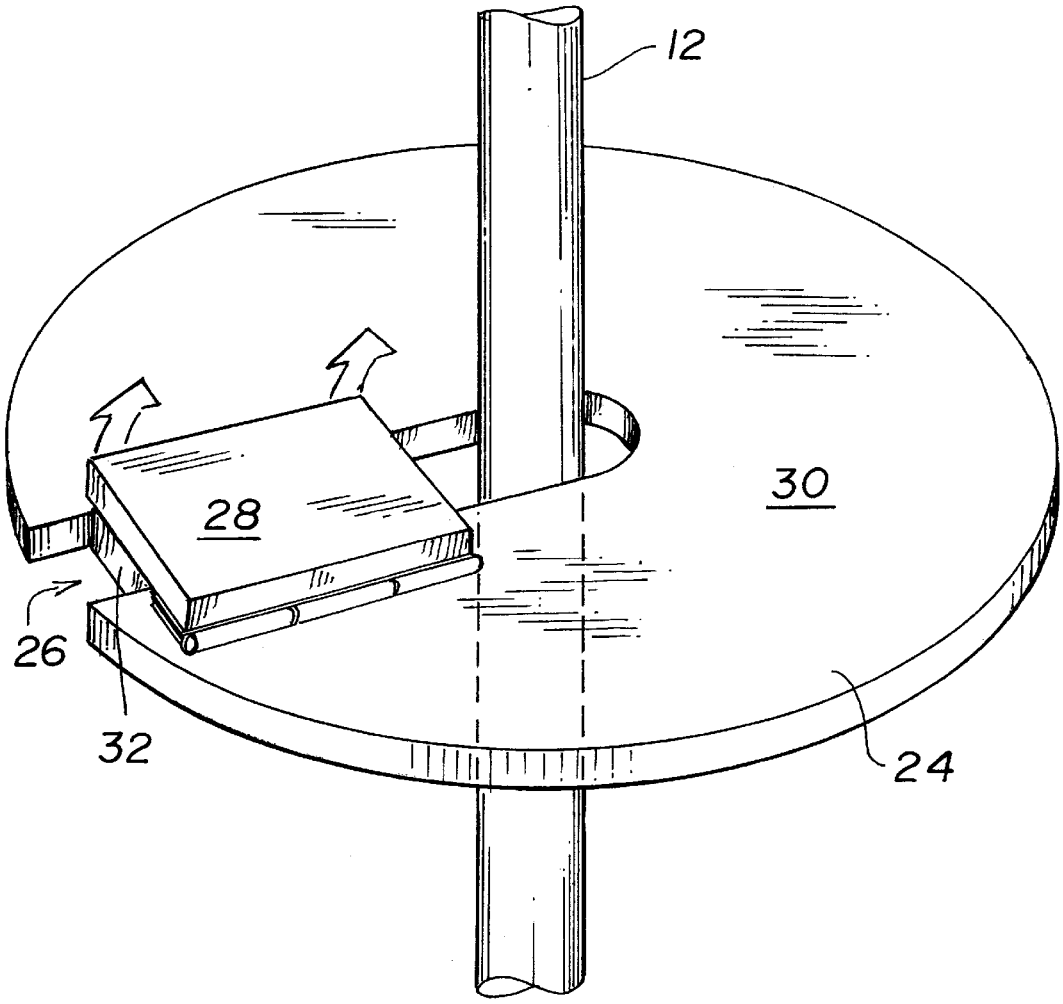
FIG. 5 is a pictorial view of the shield of FIG. 4 with a dust flap according to the present invention.

Turning to FIG. 5, an additional feature is preferably provided in the shield 24. A dust flap 28 is, preferably, hingedly connected to the shield, disposed across the slot 26, on an upper face 30 of the shield. The dust flap leaves space for the shaft 12 to penetrate through the slot but preferably covers the slot over substantially the remaining length thereof. The dust flap is lifted in the direction of the arrows for maneuvering the shaft into the position shown in FIG. 5, and the dust flap is returned to the position shown in the Figure when the shaft is in position for mixing. The dust flap substantially prevents particulate matter from escaping upwardly, in the direction of the arrows "A" in FIG. 4.

Preferably, the dust flap includes a plug portion 32 that extends into the slot to reduce the amount of open space therein. Because the disc has thickness, particulate matter may escape through the slot radially outwardly in the direction of the arrow "B" in FIG. 4, even when the dust flap covers the slot. However, the plug portion 32 blocks the aperture to hinder or prevent the aperture from being a conduit for particles thrown radially outwardly into the surrounding air as a result of mixing.

It is to be recognized that, while a particular impeller and shield for a mixing apparatus has been shown and described as preferred, other configurations and methods could be utilized, in addition to those already mentioned, without departing from the principles of the invention.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

What is claimed is:

1. An impeller for a mixing apparatus, comprising:

a substantially planar disc having a hole through the center for receiving a motor driven shaft mixing member, said planar disc having upper and lower opposite faces and one or more apertures therethrough, with each of said apertures having an upper periphery defining an edge of said lower face and a lower periphery defining an edge of said upper face, wherein points of said lower face extend from said upper periphery at first angles with respect to the plane of the planar disc that are a function of the radial locations of said points, and wherein radially corresponding points of said upper face extend from said lower periphery at second angles that are substantially equal to the corresponding said first angles, and wherein said apertures have radially innermost ends and radially outermost ends at which said first and second angles are substantially zero, and wherein said first and second angles increase from each of said ends to reach a maximum substantially mid-way therebetween.

2. The impeller of claim 1, wherein said maximum of said first and second angles is about 20–25 degrees.

3. The impeller of claim 1, wherein said planar disc includes a scraping flap member hingedly connected thereto.

4. The impeller of claim 1, wherein said mixing apparatus further includes a shield comprising a substantially planar shield member having spaced apart upper and lower opposite surfaces and an elongate aperture therethrough, said shield having an open end at the periphery thereof for receiving the motor driven shaft into and through said aperture, and a dust flap member disposed over said aperture so as to avoid interfering with the shaft when the shaft extends through said aperture, said dust flap member having a plug portion adapted to fit into said aperture and thereby to reduce the amount of open space therein.

5. The shield of claim 4, wherein said aperture is a slot extending from said periphery to a substantially central portion of said shield.

* * * * *